US007530796B2

(12) United States Patent
Yu et al.

(10) Patent No.: US 7,530,796 B2
(45) Date of Patent: May 12, 2009

(54) COMPRESSORS

(75) Inventors: Long Sheng Yu, South Grafton, MA (US); Paul D. Goldman, Marlborough, MA (US)

(73) Assignee: The Gillette Company, Boston, MA (US)

( * ) Notice: Subject to any disclaimer, the term of this patent is extended or adjusted under 35 U.S.C. 154(b) by 415 days.

(21) Appl. No.: 11/007,427

(22) Filed: Dec. 7, 2004

(65) Prior Publication Data

US 2006/0120897 A1 Jun. 8, 2006

(51) Int. Cl.
*F04B 49/20* (2006.01)
*F04B 17/03* (2006.01)
*A61C 17/02* (2006.01)

(52) U.S. Cl. ..... 417/212; 417/313; 433/80

(58) Field of Classification Search ..... 417/412, 417/413.1, 212, 313; 433/80
See application file for complete search history.

(56) References Cited

U.S. PATENT DOCUMENTS 4,735,200 A 4/1988 Westerman
4,818,191 A * 4/1989 Schlake ..... 417/390
4,906,187 A 3/1990 Amadera
5,219,274 A * 6/1993 Pawlowski et al. ..... 417/213
5,332,370 A * 7/1994 Nakayama et al. ..... 417/413.1
5,690,017 A * 11/1997 Riedlinger ..... 92/100
6,065,389 A 5/2000 Riedlinger
6,164,967 A 12/2000 Sale et al.
6,347,614 B1 * 2/2002 Evers et al. ..... 123/446
6,902,337 B1 6/2005 Kuo

FOREIGN PATENT DOCUMENTS

WO WO 2004/049968 6/2004
WO 2006/062570 6/2006

OTHER PUBLICATIONS

Written Opinion received in PCT/US2005/035826, dated Jun. 7, 2007, 5 pages.

* cited by examiner

*Primary Examiner*—Devon C Kramer
*Assistant Examiner*—Patrick Hamo
(74) *Attorney, Agent, or Firm*—Fish & Richardson P.C.; Vladimir Vitenberg

(57) ABSTRACT

Compressors are provided which include a motor having a drive shaft; a compression chamber, having an inlet and an outlet; a diaphragm, disposed within the compression chamber such that when the diaphragm is deflected back and forth between a first position and a second position air is drawn in through the inlet and forced out through the outlet; a crankshaft, operatively connected to the drive shaft; a shuttle, configured to be displaced transversely by rotational movement of the crankshaft, and positioned to deflect the diaphragm by its transverse movement; and a guide configured to inhibit non-transverse motion of the shuttle. In some implementations, the compressor occupies a total volume of less than about 15 cubic inches.

30 Claims, 5 Drawing Sheets

611B
606
611A
614B
621
614A
620
610
605
608A
628
607
612
640
601
630
632
652
604
636
638
603
634
650
600

COMPRESSORS

TECHNICAL FIELD

This invention relates to compressors.

BACKGROUND

Small compressors have been used to deliver a stream of air to a user of a hand-held oral care devices, e.g., as described in WO 2004/049968. It is desirable that such compressors be compact, to provide a personal care device having an ergonomic shape, while also being efficient.

SUMMARY

Aspects of the invention feature small, compact compressors. The small size and compact geometry of the compressors allows the compressors to be contained in ergonomically shaped housings such as the housing of a hand-held oral care device or other personal care device.

In one aspect, the invention features a compressor including: (a) a motor having a drive shaft; (b) a compression chamber, having an inlet and an outlet; (c) a diaphragm, disposed within the compression chamber such that when the diaphragm is deflected back and forth between a first position and a second position air is drawn in through the inlet and forced out through the outlet; (d) a crankshaft, operatively connected to the drive shaft; (e) a shuttle, configured to be displaced transversely by rotational movement of the crankshaft, and positioned to deflect the diaphragm by its transverse movement; and (f) a guide configured to inhibit non-transverse motion of the shuttle.

The compressor preferably occupies a total volume (i.e., the volume of the compressor including all of the components listed above) of less than about 15 cubic inches, e.g., less than 10 inches. In some cases, the total volume occupied by the compressor may be even smaller, e.g., 5 cubic inches or less.

Preferred compressors have a linear configuration. By "linear configuration," we mean that the motor that drives the compressor and the housing in which the components of the compressor are contained (the compressor housing) are linearly aligned, and of a similar diameter.

In some preferred compressors, the guide is configured to restrict movement of the shuttle to movement along an axis perpendicular to the plane of the planar surface of the diaphragm. In some implementations, the compressor comprise two diaphragms, each diaphragm being disposed within a compression chamber, and the shuttle and crankshaft are configured so that back and forth movement of the shuttle deflects the diaphragms in alternation, resulting in alternating compression in the two chambers.

In some embodiments, the compressors exhibit one or more of the following advantages. The compressor provides good air pressure and flow. In some implementations, the compressor has an output of at least 4 liters/min at a pressure of 15 psi, or at least 3 liters/min at a pressure of 8 psi. The compressor has a "sandwich" configuration for ease of assembly. The compressor exhibits minimal diaphragm wobble, resulting in high output and long diaphragm life. Like conventional diaphragm compressors, the output air is clean, i.e., substantially free of contaminants such as lubricant and particulate material.

The details of one or more embodiments of the invention are set forth in the accompanying drawings and the description below. Other features, objects, and advantages of the invention will be apparent from the description and drawings, and from the claims.

DETAILED DESCRIPTION

The compressors described herein may be used, for example, in hand-held oral care devices, for example those described in U.S. Ser. No. 10/960,467, "Oral Care Systems, Oral Care Devices and Methods of Use," filed Oct. 7, 2004, the complete disclosure of which is incorporated herein by reference. The compressor may be contained within the handle of the hand-held device, or in some cases may be disposed in a docking station with which the handle is in fluid communication.

As discussed above, it is preferred that the compressor have a linear configuration. In the embodiment shown in FIGS. 1-3, a linear configuration is accomplished by using a shuttle to replace connecting rods used in conventional diaphragm and piston compressors. In conventional compressors, typically the motor and compressor housing are perpendicularly aligned, and thus the compressor geometry is less suitable for ergonomically fitting into a handle.

Figure 1:
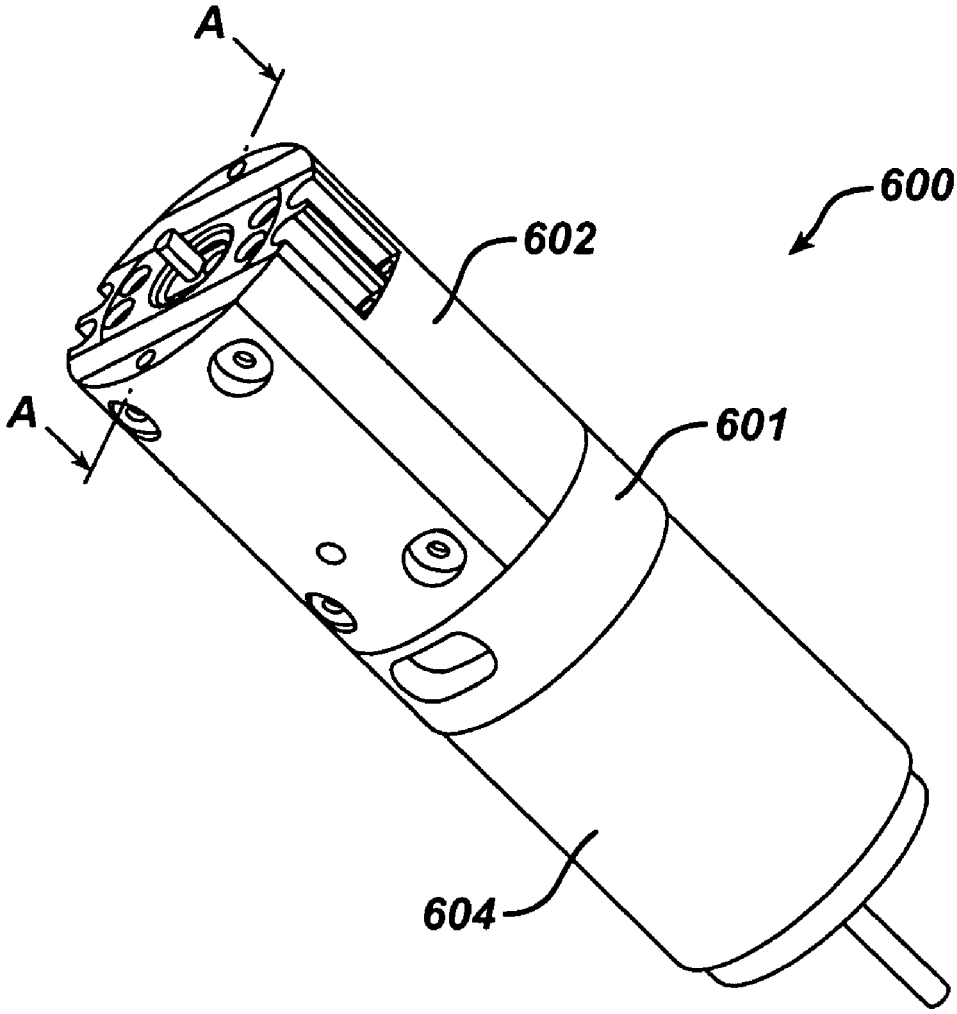
FIG. 1 is a perspective view of a compressor according to one embodiment of the invention.
Figure 2:
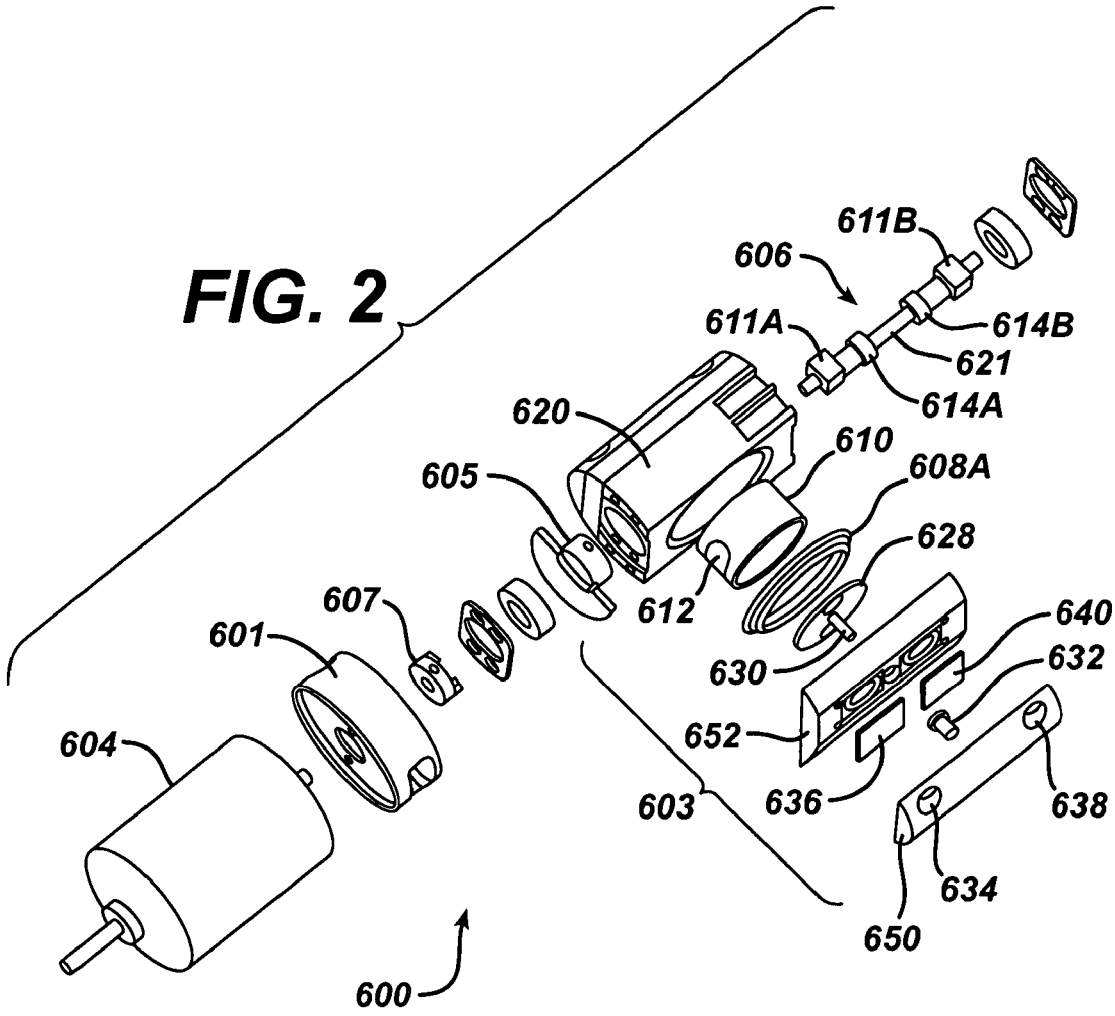
FIG. 2 is a partially exploded perspective view showing the components of the compressor of FIG. 1 (only one side of the dual diaphragm compressor assembly is exploded out; the other half remains in the compressor housing).
Figure 3:
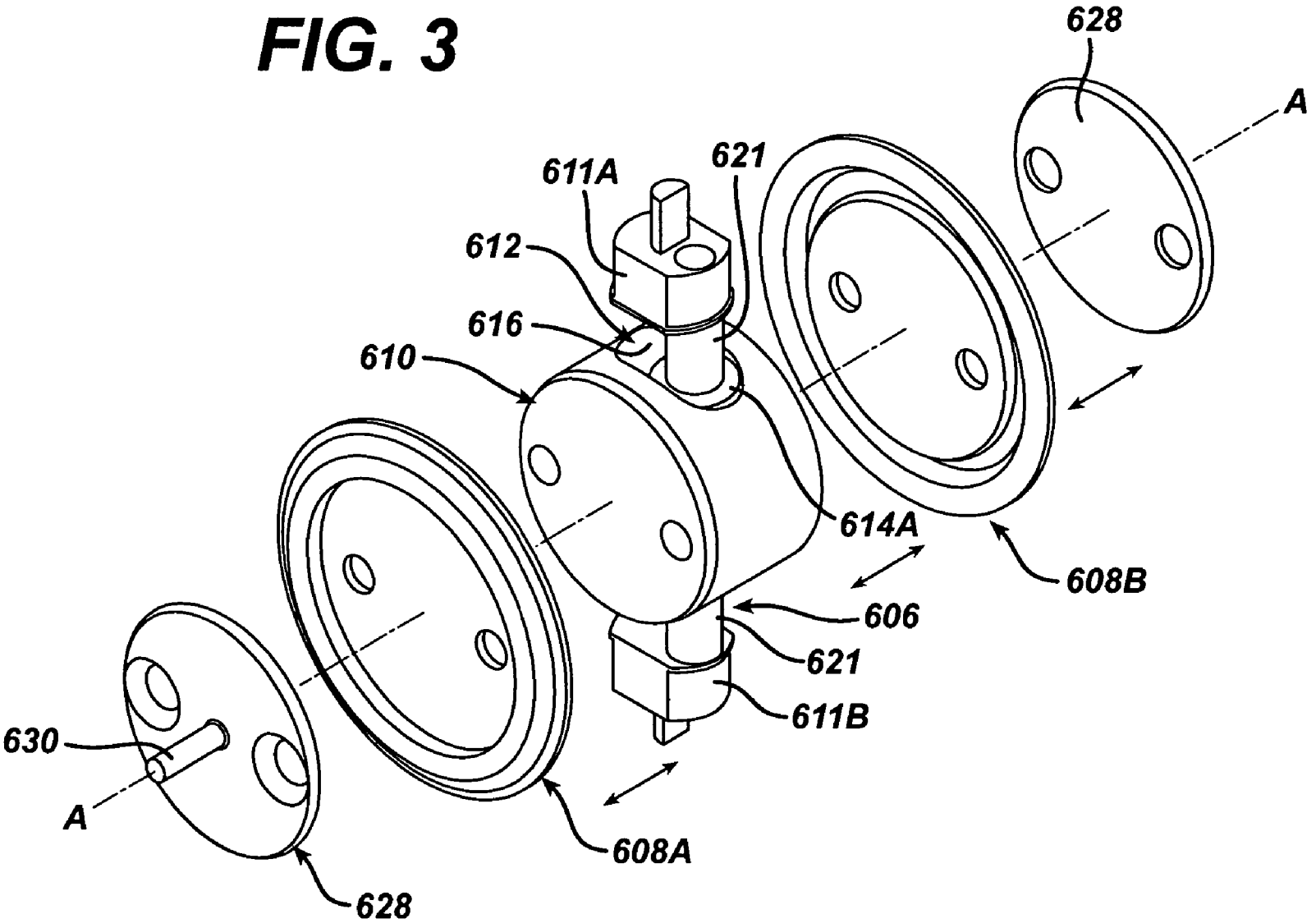
FIG. 3 is an enlarged exploded view of a subset of the components of the compressor.
Figure 4:
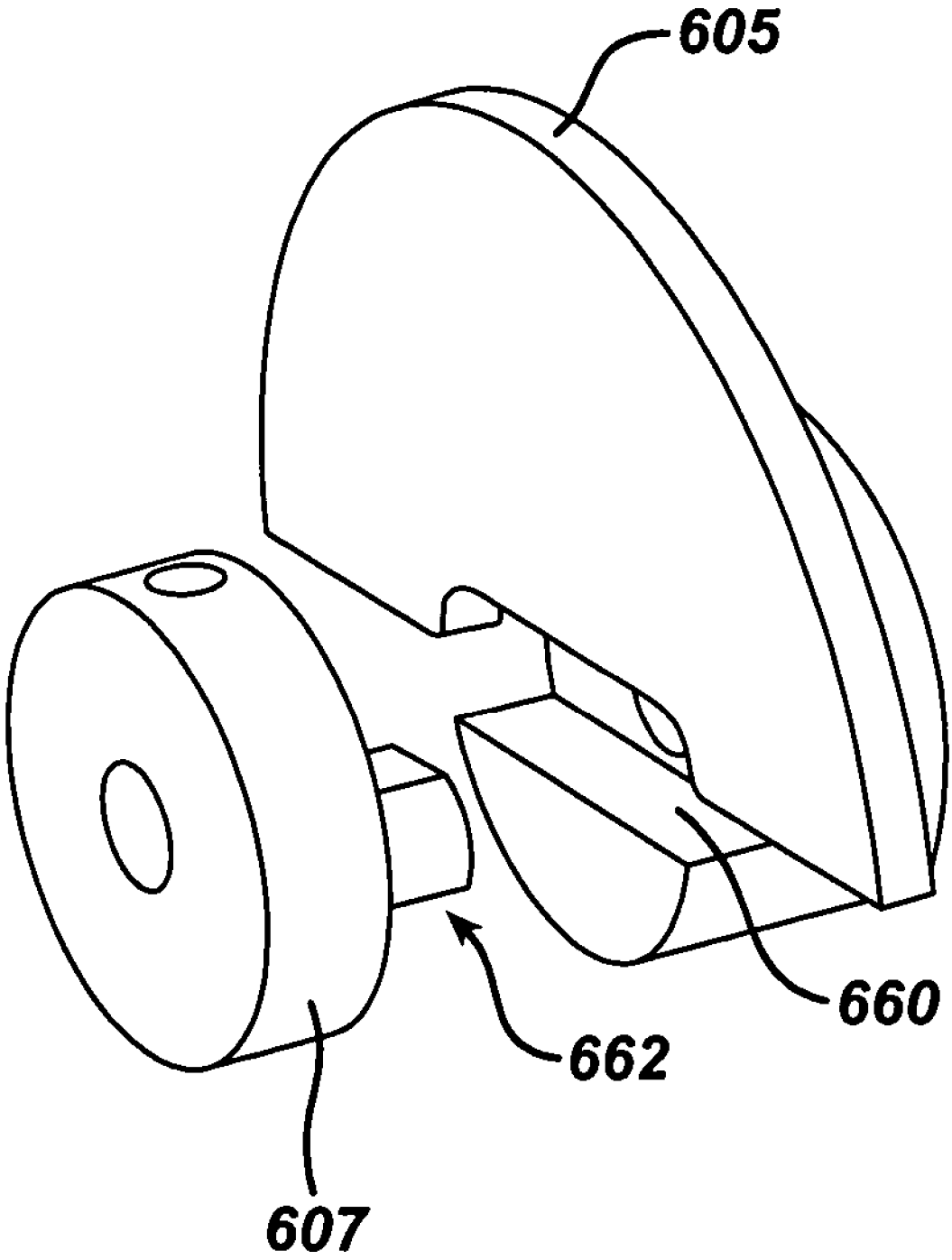
FIG. 4 is a highly enlarged perspective view of a counterweight assembly used in the compressor of FIGS. 1-2.

Referring to FIGS. 1-3, compressor 600 includes a compressor assembly 602 and a motor 604, joined to the compressor assembly by a motor mount 601 that includes a counterweight 605 (FIG. 4) that is mounted on the crankshaft of the compressor assembly, and a keyed shaft coupling 607 that is mounted on the motor shaft, e.g., by a set screw. The counterweight 605 is generally fan-shaped (has the shape of a half of a disk), minimizing the space occupied by the counterweight and reducing compressor vibration. Preferably, as shown, the compressor assembly is joined directly to the motor, without the use of a bevel gear. The counterweight 605 includes a slot 660 that is coupled with cooperating protrusions 662 on the keyed coupling 607 to join the motor shaft to the crankshaft. This slot/key coupling eliminates the need for precise alignment of the motor shaft and crankshaft assembly. It also allows relatively large amounts of torque to be transferred from the motor to the compressor assembly with minimal power loss and coupling size.

Compressor assembly 602 includes two halves, each half including a diaphragm and valve head assembly 603, shown in detail in FIG. 2 and discussed below. Each diaphragm and valve head assembly 603 includes its own air intake and outlet, and each provides a flow of compressed air, as will be explained below. Compressor 600 may have, for example, a diameter of less than about 1.25 inch, with an output pressure of at least 15 psi and flow rate of at least 4 liters/min.

Referring to FIGS. 2-3, a crankshaft 606, which extends from and is driven by motor 604, causes the alternating deflection of two diaphragms 608A, 608B, disposed on opposite sides of the shuttle 610, each diaphragm being part of one of the diaphragm and valve head assemblies. Crankshaft 606 includes a rod 621, eccentrically mounted on a pair of shaft mounts 611A, 611B, and a pair of rollers or bearings 614A, 614B. The lower shaft mount 611A is collinearly mounted on a drive shaft of the motor 604, so that rotation of the drive shaft causes crankshaft 606 to drive the shuttle 610 back and forth, resulting in deflection of the diaphragms.

Shuttle 610 includes a rectangular slot 612, through which the crankshaft extends, with rollers 614A, 614B of the crankshaft (FIG. 2) being dimensioned to contact the inner wall 616 of the slot 612. When the crankshaft rotates, the shuttle 610 translates back and forth along a center axis A of the diaphragms (arrows, FIG. 3). This motion of the shuttle pushes the diaphragms 608A, 608B in and out of respective compression chambers 618A, 618B, defined by a pair of elastomeric domes 619 (FIG. 1A) that are positioned in housing 620. Deflection of the diaphragms by the shuttle draws air into the compression chambers and then expels air out of the outflow of the compressor. Each of the diaphragms includes a convolute 622, which causes the diaphragms to deflect with a rolling movement, which tends to extend the life of the diaphragms. The use of the shuttle 610 minimizes the distance between the two diaphragms to the thickness of the shuttle, e.g., to less than about 0.5 inch.

Figure 1A:
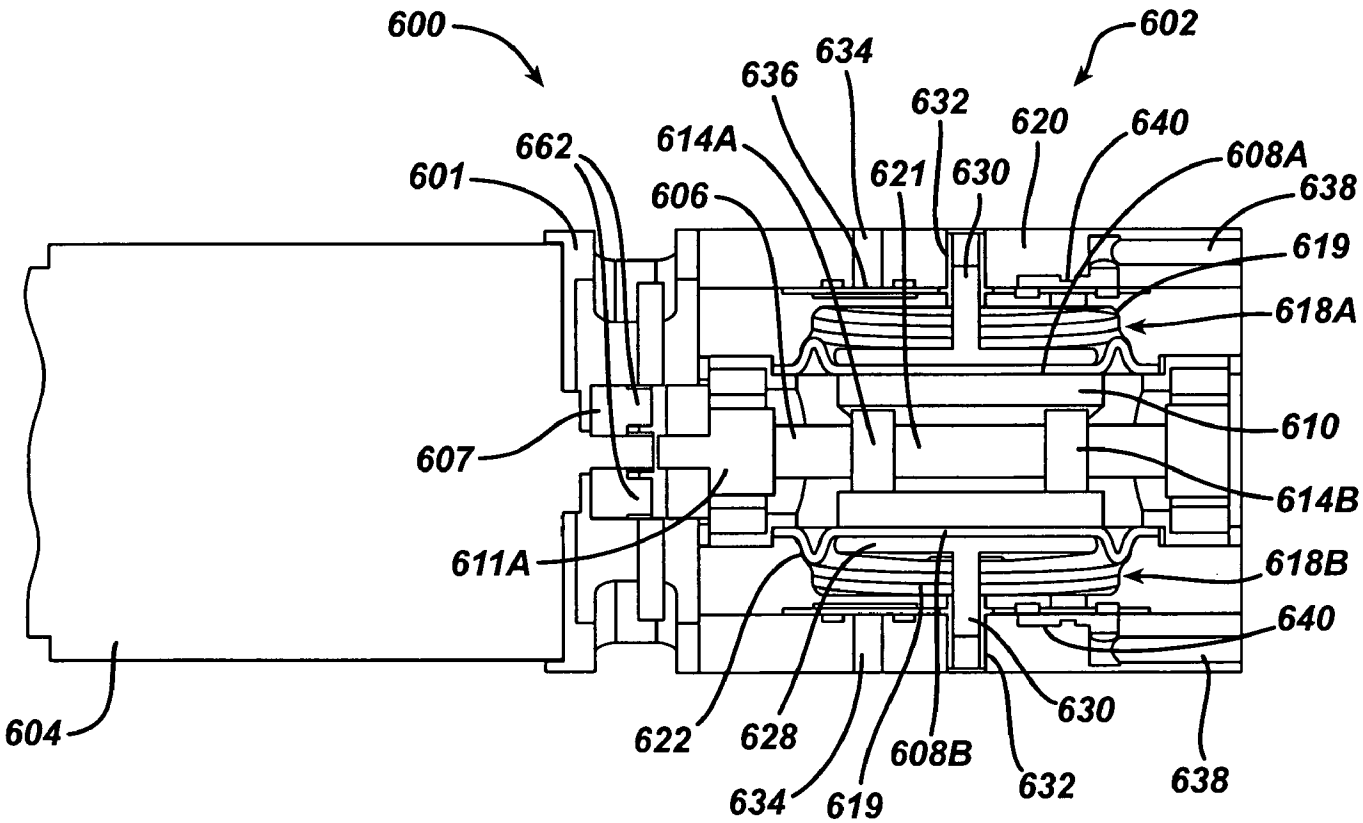
FIG. 1A is a cross-sectional view of the compressor, taken along line A-A in FIG. 1.

For maximum efficiency and diaphragm life, it is desirable that motion of the shuttle be limited, as much as possible, to motion along axis A. The rectangular shape of slot 612 inhibits motion in other directions. Motion in other directions is further inhibited by a guide pin 630 that extends from each of a pair of guide disks 628, generally along axis A. Referring to FIG. 1A, each guide pin is mounted for sliding movement in a guide sleeve 632 in housing 620. Thus, non-axial movement of the shuttle and diaphragm is constrained by guide disk 628 which moves linearly along axis A due to the sliding engagement of guide pin 630 in guide sleeve 632. It is generally preferred that the guide pins be formed of durable, smooth materials, for example polished stainless steel, e.g., having a hardness of about Rc 16 to 68, preferably about 48 to 54, and that the guide sleeves be formed of low friction materials, for example polymers such as TEFLON, DELRIN, and PEEK polymers.

Because the guide pins inhibit wobbling and other non-axial movement, the headspace clearance, i.e., the distance between the diaphragm and dome at the top of the compression stroke, is reduced. Generally, the headspace clearance is less than about 0.050", preferably less than about 0.025", and most preferably less than about 0.010". Because the diaphragm can get closer to the dome, the headspace that would have otherwise been needed to compensate for diaphragm wobble can instead be used for additional stroke volume, thereby increasing compression.

The use of the guide pins and guide sleeves generally requires venting of the air that is moving inside the sleeve, under the force of the guide pin. This may be accomplished in any desired manner. For example, the top of the guide sleeve may be open to the atmosphere, in which case an o-ring would generally be placed around the guide pin as a seal. Alternatively, the pin/sleeve gap may be increased, e.g., by making the guide pin diameter sufficiently small so that air in the sleeve can escape into the compression chamber through the gap. Other alternatives include using a hollow guide pin that is vented through its side wall, and routing air through grooves on the pin surface and/or channels in the cap and housing.

It is advantageous, for ease of manufacturing, that the compressor has a "sandwich" or "stacked" configuration. Referring to FIG. 2, each side of the compressor is assembled as a stack including the disk, diaphragm and shuttle, and, sandwiching the assembly together, an outer cap 650, a middle cap 652 and the housing 620. Outer cap 650 and middle cap 652 includes through-channels for passage of air from inlet 634 and to outlet 638. This sandwich configuration may allow the compressor to be mass-produced using conventional molding processes.

Referring to FIG. 1A, when the compressor is in use, air is drawn into each side of the compressor through inlet 634. Air is then compressed first in one chamber 618A, and then in the other chamber 618B, by the reciprocating motion of the shuttle. Thus, air is expelled first from one air outlet 638 and then from the other, providing a steady stream of compressed air. Inlet 634 and outlet 638 are provided with valves 636 and 640, respectively, (e.g., flapper valves) to control the flow of air into and out of the compressor. The back and forth movement of the shuttle, resulting in this alternating compression in the two chambers, minimizes pumping losses by eliminating the need to vent "crankcase-side" air from the compressor. Because there is no need to vent air from the compressor, there is also no need to release such vented air from the device in which the compressor is contained, which may be advantageous, for example, if the compressor is enclosed within the handle of a hand-held device. Moreover, because there is no need to vent air, a possible leak point is eliminated, which may be advantageous for devices that dispense a liquid and/or are used in a wet environment.

If desired, a similar linear configuration could be used in a single diaphragm compressor, or in compressors having more than two diaphragms, e.g., three or more. The compressor can be converted to a single diaphragm compressor simply by removing one diaphragm from one of the sides. This configuration reduces power requirements, but will also produce a corresponding decrease in output. Redesigning the single diaphragm configuration to eliminate unused portions of the housing can reduce the size of the compressor.

A number of embodiments of the invention have been described. Nevertheless, it will be understood that various modifications may be made without departing from the spirit and scope of the invention.

For example, while the compressors described herein are particularly suited for use in oral care devices, as discussed above, they may be used in any application in which a high efficiency, compact compressor is needed. Other applications include various hand-held devices and containers that expel air or other products (in the latter case, the compressed air generated by the compressor may be used in place of a propellant or pump to provide a dispensing pressure.)

Moreover, the guide pins may be fixed in the domes, rather than extending from the shuttle. In this case, the shuttles would include sleeves that would allow the shuttles to slide along the pins, with a seal provided around each sleeve. Also with regard to the guide pins, more than one pin may be provided to guide each shuttle, if desired.

While the use of the compressor to supply compressed air has been discussed above, the inlet and outlet may be reversed, and the compressor used to apply suction.

While a cylindrical compressor is shown in the drawings, the compressor may have any desired elongated shape. For example, it may be oval or rectangular in cross-section.

Additionally, the counterweight may be positioned at other locations perpendicular to the A axis, for example on the side of the compressor opposite the motor.

Accordingly, other embodiments are within the scope of the following claims.

What is claimed is:

1. A compressor comprising:

a motor having a drive shaft;

a compression chamber, having an inlet and an outlet;

a diaphragm, disposed within the compression chamber such that when the diaphragm is deflected back and forth between a first position and a second position air is drawn in through the inlet and forced out through the outlet;

a crankshaft, operatively connected to the drive shaft;

a shuttle, configured to be displaced transversely by rotational movement of the crankshaft, and positioned to deflect the diaphragm by its transverse movement; and a guide configured to inhibit non-transverse motion of the shuttle, wherein the guide includes a guide pin and the guide pin extends from a guide disk positioned adjacent the diaphragm opposite the shuttle;

the compressor occupying a total volume of less than about 15 cubic inches.

2. The compressor of claim 1 wherein the guide is configured to restrict movement of the shuttle to movement along an axis perpendicular to the plane of the planar surface of the diaphragm.

3. The compressor of claim 1 wherein the crankshaft is eccentrically mounted on the drive shaft so that rotation of the drive shaft causes the crankshaft to drive the shuttle back and forth.

4. The compressor of claim 3 wherein the shuttle is configured to translate pivoting movement of the crankshaft into deflection of the diaphragm.

5. The compressor of claim 3 wherein the shuttle includes a rectangular slot through which the crankshaft extends.

6. The compressor claim 1 wherein the diaphragm includes a convolute which causes the diaphragm to deflect with a rolling movement.

7. The compressor of claim 1 wherein the guide is configured so that movement of the shuttle is substantially entirely in a direction oriented along a center axis of the diaphragm.

8. The compressor of claim 1 wherein the diaphragm, shuttle and guide disk are contained within a compressor housing, and the guide pin is mounted for sliding movement in a guide sleeve in the compressor housing.

9. The compressor of claim 8 further comprising a vent to allow air to escape from within the guide sleeve when the air is compressed by movement of the guide pin.

10. The compressor of claim 1 wherein the guide pin extends into the compressor chamber, and is in sliding engagement with a sleeve in the shuttle.

11. The compressor of claim 10 further comprising a seal between the guide pin and sleeve.

12. The compressor of claim 1 wherein the compressor includes a compressor housing in which the diaphragm, compression chamber, crankshaft, shuttle and guide are disposed.

13. The compressor of claim 12 wherein the compressor housing has a maximum diameter of less than about 1.25 inch.

14. The compressor of claim 12 wherein the compressor housing is generally cylindrical.

15. The compressor of claim 1 further including a generally fan-shaped counterweight.

16. The compressor of claim 1 wherein the motor shaft is coupled to the crankshaft by a keyed coupling.

17. The compressor of claim 1 wherein the compressor comprises two or more diaphragms.

18. The compressor of claim 1 wherein the compressor comprises only a single diaphragm.

19. The compressor of claim 1 wherein the compressor is configured to have a headspace clearance of less than about 0.050".

20. The compressor of claim 19 wherein the compressor is configured to have a headspace clearance of less than about 0.025".

21. The compressor of claim 20 wherein the compressor is configured to have a headspace clearance of less than about 0.010".

22. The compressor of claim 1 wherein the shuttle has a thickness of less than about 0.5".

23. The compressor of claim 17 wherein the spacing between diaphragms is less than about 0.5".

24. The compressor of claim 1 wherein the total volume occupied by the compressor is less than about 10 cubic inches.

25. The compressor of claim 24 wherein the total volume occupied by the compressor is 5 cubic inches or less.

26. The compressor of claim 17 wherein the compressor comprise two diaphragms, each diaphragm being disposed within a compression chamber, and the shuttle and crankshaft are configured so that back and forth movement of the shuttle deflects the diaphragms in alternation, resulting in alternating compression in the two chambers.

27. The compressor of claim 1 wherein the inlet and outlet are configured so that the compressor will apply suction when in use.

28. An oral care device capable of ejecting air, the oral care device comprising:

an applicator including a passageway within the applicator for directing air therethrough to a head of the applicator, the head being sized to fit in a user's mouth;

a compressor configured to pressurize the air, the compressor comprising a motor having a drive shaft;

a compression chamber, having an inlet and an outlet;

a diaphragm, disposed within the compression chamber such that when the diaphragm is deflected back and forth between a first position and a second position air is drawn in through the inlet and forced out through the outlet;

a crankshaft, operatively connected to the drive shaft;

a shuttle, configured to be displaced transversely by rotational movement of the crankshaft, and to deflect the diaphragm by its transverse movement; and a guide configured to inhibit non-transverse motion of the shuttle, wherein the guide includes a guide pin and the guide pin extends from a guide disk positioned adjacent the diaphragm opposite the shuttle;

the compressor occupying a total volume of less than about 15 cubic inches.

29. A compressor comprising:

a motor having a drive shaft;

a compression chamber, having an inlet and an outlet, within a compressor housing;

a diaphragm, disposed within the compression chamber such that when the diaphragm is deflected back and forth between a first position and second position air is drawn in through the inlet and forced out through the outlet;

a crankshaft, operatively connected to the drive shaft;

a shuttle, configured to be displaced transversely by rotational movement of the crankshaft, and positioned to deflect the diaphragm by its transverse movement; and a guide configured to inhibit non-transverse motion of the shuttle, the guide including a guide pin that extends into the compressor chamber and is in sliding engagement with a sleeve in the compressor housing;

the compressor occupying a total volume of less than about 15 cubic inches.

30. An oral care device capable of ejecting air, the oral care device comprising:

an applicator including a passageway within the applicator for detecting air therethrough to a head of the applicator, the head being sized to fit in user's mouth;

a compressor configured to pressurize the air, the compressor comprising a motor having a drive shaft;

a compression chamber, having an inlet and an outlet, within a compressor housing;

a diaphragm, disposed within the compression chamber such that when the diaphragm is deflected back and forth between a first position and a second position air is drawn in through the inlet and forced out through the outlet;

a crankshaft, operatively connected to the drive shaft;

a shuttle, configured to be displaced transversely by rotational movement of the crankshaft, and positioned to deflect the diaphragm by its transverse movement;

a guide configured to inhibit non-transverse motion of the shuttle, the guide including a guide pin that extends into the compressor chamber and is in sliding engagement with a sleeve in the compressor housing; and the compressor occupying a total volume of less than about 15 cubic inches.

* * * * *

UNITED STATES PATENT AND TRADEMARK OFFICE

CERTIFICATE OF CORRECTION

PATENT NO. : 7,530,796 B2
APPLICATION NO. : 11/007427
DATED : May 12, 2009
INVENTOR(S) : Long Sheng Yu and Paul D. Goldman It is certified that error appears in the above-identified patent and that said Letters Patent is hereby corrected as shown below:

Column 5, line 34 (Claim 6), after “compressor” please insert -- of --.

Column 7, line 6 (Claim 30), please delete “detecting” and insert -- directing -- therefor.

Column 7, line 7 (Claim 30), after “in” please insert -- a --.

Signed and Sealed this

Thirtieth Day of June, 2009

John Doll

JOHN DOLL
*Acting Director of the United States Patent and Trademark Office*